United States Patent [19]

Suzuki et al.

[11] Patent Number: 4,481,739

[45] Date of Patent: Nov. 13, 1984

[54] GRINDING MACHINE WITH DUAL TURRETS

[75] Inventors: Ikuo Suzuki, Chiryu; Kunihiko Unno, Kariya; Norio Ohta, Okazaki, all of Japan

[73] Assignee: Toyoda Koki Kabushiki Kaisha, Kariya, Japan

[21] Appl. No.: 420,629

[22] Filed: Sep. 21, 1982

[30] Foreign Application Priority Data

Oct. 9, 1981 [JP] Japan ..... 56-161478

[51] Int. Cl.[3] ..... B24B 9/00

[52] U.S. Cl. ..... 51/5 D; 51/80 R; 51/84 R; 51/166 T; 125/11 CD

[58] Field of Search ..... 51/80 R, 80 A, 83 R, 51/84 R, 89, 166 T, 216 ND, 5 D, 40–42, 236, 53, 232, 2 F; 125/11 R, 11 CD

[56] References Cited

U.S. PATENT DOCUMENTS

| | | | |
|---|---|---|---|
| 1,637,074 | 3/1923 | Gaisman et al. | 51/166 T |
| 2,298,979 | 10/1942 | Simons | 51/53 |
| 2,735,235 | 2/1956 | Luers | 51/84 R |
| 3,048,949 | 8/1962 | Johnson | 51/216 ND |
| 3,431,685 | 3/1969 | Hahn | 51/166 |
| 3,503,155 | 3/1970 | Dunn | 51/114 |
| 4,103,668 | 8/1978 | Nishimura et al. | 51/165.71 |

*Primary Examiner*—Frederick R. Schmidt
*Assistant Examiner*—Matthew D. Daschel
*Attorney, Agent, or Firm*—Oblon, Fisher, Spivak, McClelland & Maier

[57] ABSTRACT

A grinding machine is provided wherein a pair of wheel slides are disposed respectively at both sides of a work support to be movable toward and away from the work table in a first direction. The wheel slides respectively carry turrets thereon in such a manner that each of the turrets is rotationally indexed about and slidable along an axis thereof extending in a second direction perpendicular to the first direction. Each of the turrets carries a plurality of grinding wheels which are rotatable about respective axes extending in the second direction, and when rotationally indexed selectively presents the grinding wheels to a machining station. The position of a selected one of the grinding wheels relative to a workpiece on the work support is adjusted in the first direction through the movement of each wheel slide and in the second direction through the movement of each turrets. Upon completion of the position adjustments, the work support is moved in a third direction perpendicular to said first and second directions, so that the workpiece is ground as it passes between a pair of grinding wheels having been presented to the machining station.

7 Claims, 3 Drawing Figures

GRINDING MACHINE WITH DUAL TURRETS

BACKGROUND OF THE INVENTION

1. Field of the Invention

The present invention relates to a grinding machine of the type wherein a work support carrying a workpiece is passed between a pair of grinding wheels disposed at both sides thereof for simultaneously grinding a pair of opposite end surfaces of the workpiece.

2. Description of the Prior Art

Turbine blades as used in aircraft jet engines have at their opposite ends mounting portions whose outer surfaces must be ground. In a known grinding machine for this purpose, a pair of wheel slides are respectively disposed at both sides of a work support which is movable along a horizontal slide way. A grinding wheel whose circumferential surfaces take a form corresponding to a portion of a workpiece to be ground is supported on each of the wheel slides for rotation about a vertical axis. In operation, the pair of wheel slides are horizontally infed toward each other to thereby adjust the positions of the grinding wheels thereon relative to the work support. The work support is subsequently moved to cause the workpiece carried thereon to pass between the grinding wheels, which result in simultaneously grinding a pair of opposite end surfaces of the workpiece.

In the case where the workpiece has a complicated shape, like the mounting portions of the turbine blades, it is impossible for the known grinding machine to grind all of the outer surfaces of the workpiece. Accordingly, it has been a practice to use a number of grinding machines of the aforementioned type which are connected in series by workpiece transfer devices. A pair of grinding wheels carried on each of the grinding machines are formed to have at their circumferential surfaces the same or independent profiles that are different from those of grinding wheels carried on the other grinding machines, so that each of the grinding machines is dedicated to grinding a pair of opposite end surfaces of the workpiece. This grinding system disadvantageously requires the provision of a plurality of dedicated grinding machines and workpiece transfer devices in addition to an extended floor space for system installation.

SUMMARY OF THE INVENTION

It is therefore an object of the present invention to provide an improved grinding machine capable of selectively indexing at least two pairs of grinding wheels to a machining station so that at least two kinds of grinding operations can be efficiently performed on either of opposite end surfaces of a workpiece.

Another object of the present invention is to provide an improved grinding machine of the character set forth above which is capable of successively grinding a plurality of workpieces carried on a work support and simultaneously grinding opposite end surfaces of each of the plurality of workpieces by moving the work support in such a way that the plurality of workpieces successively passes between any pair of grinding wheels having been indexed to a machining station.

A further object of the present invention is to provide an improved grinding machine of the character set forth above which is capable of grinding, one pair at a time, two pairs of opposite end surfaces of a workpiece which are different from one another in angular location, through only one set-up operation of the workpiece.

Still another object of the present invention is to provide an improved grinding machine of the character set forth above, wherein a plurality of pairs of grinding wheels can be efficiently and precisely dressed by bringing each selected pair of the grinding wheels into contact with a corresponding one of dressing rolls disposed in a line on a work support which is movable in a direction to selectively present the dressing tools onto a plane including the axes of each selected pair of grinding wheels.

Briefly, according to the present invention, there is provided a grinding machine comprising a pair of turrets respectively mounted on a pair of wheel slides and each carrying a plurality of grinding wheels which are rotatable about respective axes parallel to a rotational axis of an associated one of the turrets. Each of the turrets, when rotationally indexed about the rotational axis, selectively presents the grinding wheels to a machining station and, when moved along the rotational axis, adjusts the relative position between a selected one of the grinding wheels and a workpiece on a work support device. The wheel slides are respectively disposed at both sides of the work support device and are each slidable toward and away from the work support device so as to adjust the relative position between the selected one of the grinding wheels and the workpiece in a direction perpendicular to the rotational axis of the associated turret. The work support device is disposed between the wheel slides and is slidable in another direction perpendicular to the rotational axes of the turrets and to the sliding direction of the wheel slides so as to cause the workpiece to pass between a pair of grinding wheels which have been presented by the turrets to the machining station.

Since the plurality of the grinding wheels carried on each of the two turrets are selectively presented to the machining station located between the two turrets, it is possible not only to simultaneously grind a pair of opposite end surfaces of the workpiece, but also to successively perform a plurality of grinding operations on each of the opposite end surfaces in the same grinding machine. This results in avoiding the use of a plurality of dedicated grinding machines and workpiece transfer devices which may otherwise be required as has been used heretofore in grinding a workpiece having a plurality of portions to be finished.

In another aspect of the present invention, a plurality of work tables each for setting up the workpiece thereon are provided on a support slide of the work support device in a line in the sliding direction of the support slide. Therefore, the sliding movement of the support slide causes the plurality of workpieces to be ground successively and a pair of opposite end surfaces of each workpiece to be ground simultaneously.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
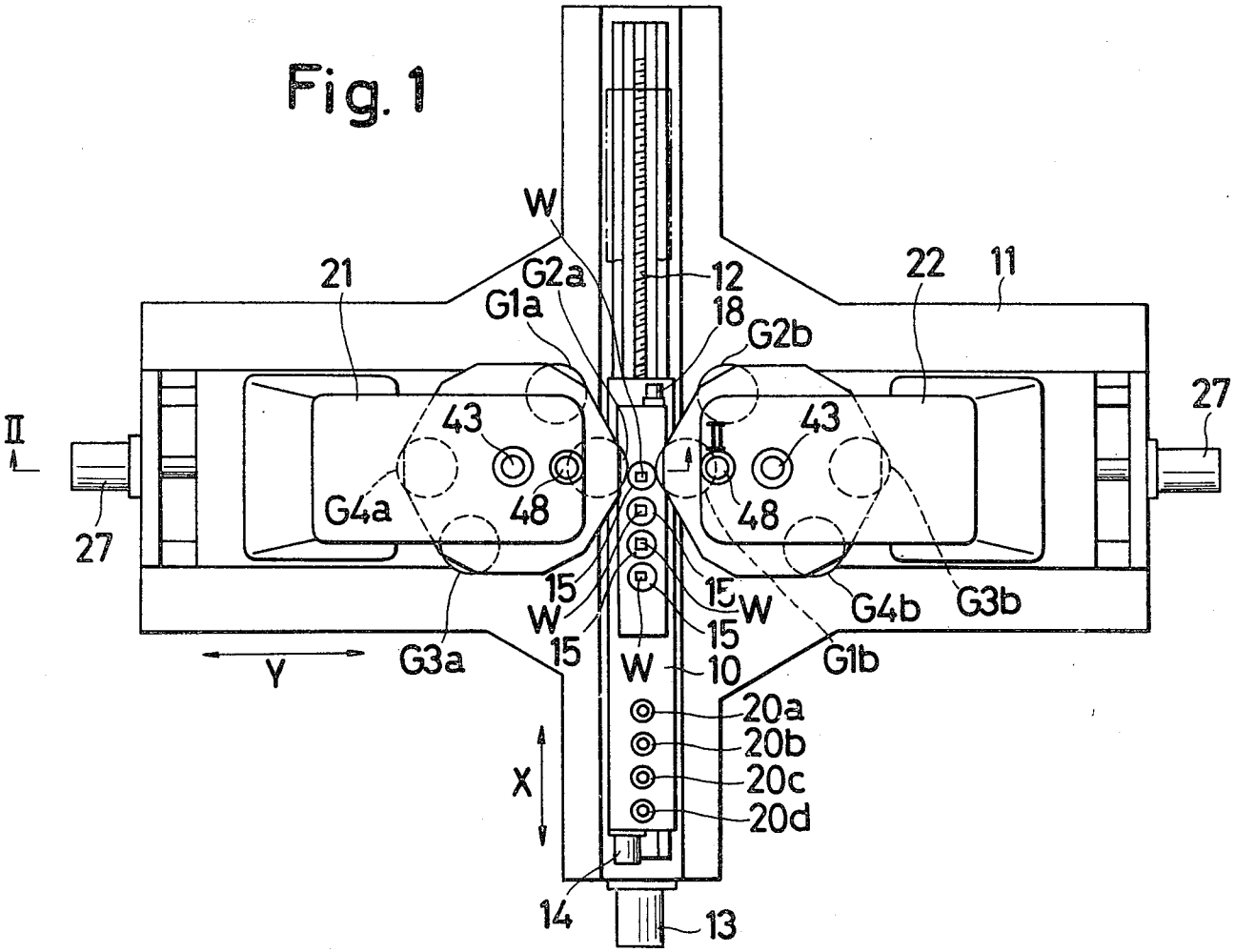
FIG. 1 is a plan view of a grinding machine according to the present invention.
Figure 2:
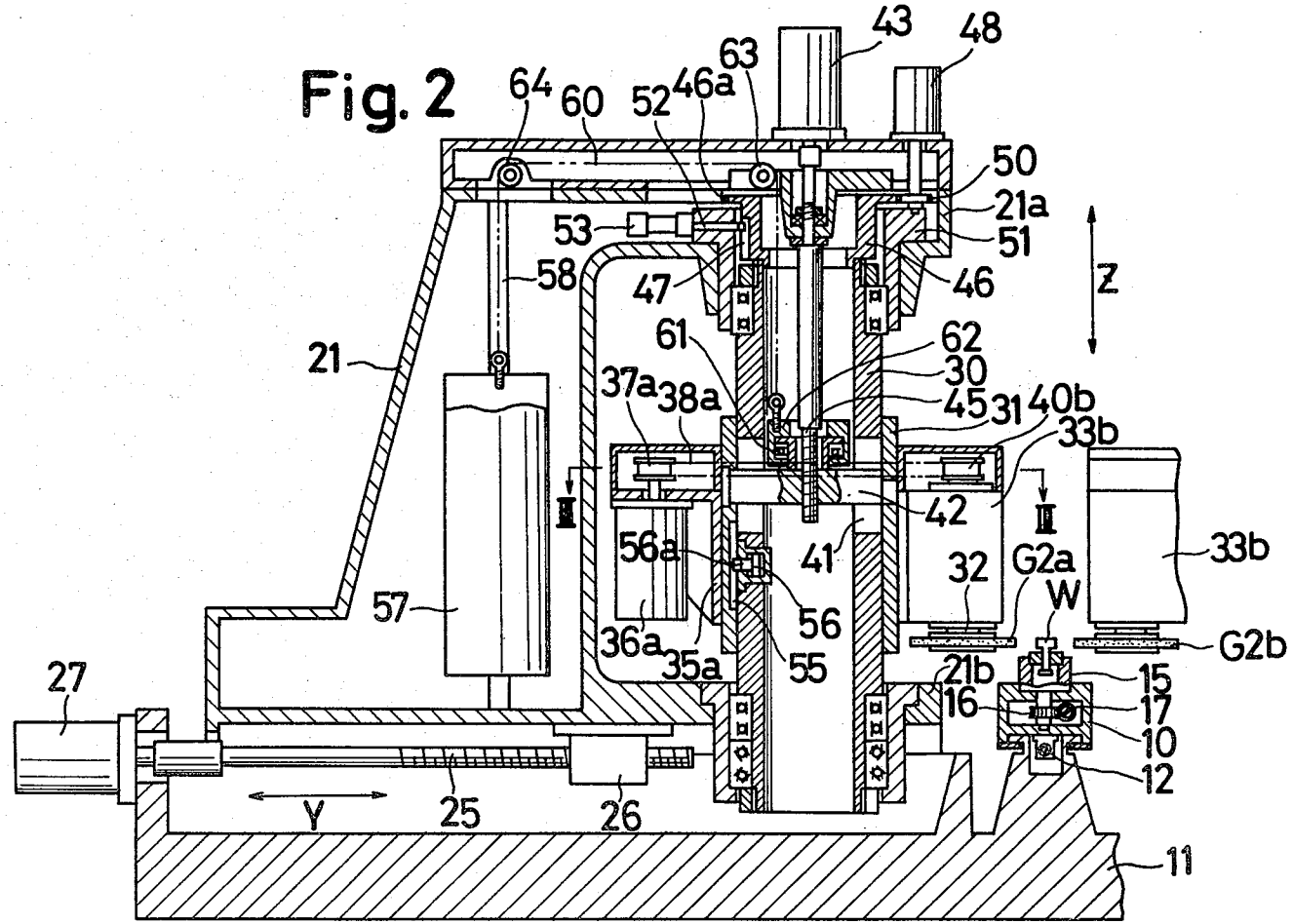
FIG. 2 is a sectional view of the machine, taken along the line II—II in FIG. 1.

Referring now to the drawings, wherein like reference numerals or characters refer to identical or corresponding parts throughout the several views, and particularly to FIG. 1 thereof, there is shown a work support 10, which is guided on a bed 11 for sliding movement in a horizontal X-axis direction. The work support 10 is threadedly engaged with a feed screw shaft 12 extending in the X-axis direction. The feed screw shaft 12 is rotatable by a work feed servomotor 13 mounted on the bed 11. A plurality of index tables 15 are disposed on the work support 10 at regular spaced intervals in the X-axis direction and are rotationally indexable by a work index motor 18, with which they are drivingly connected through respective wormwheels 16 keyed thereon and a common worm shaft 17 meshing with the wormwheels 16, as shown in FIG. 2. On each of the index tables 15, a workpiece W to be ground is mounted via a jig, not numbered, with its portions to be machined protruding from the upper surface of the index table 15.

A plurality of dressing rolls 20*a*–20*d* for respectively dressing plural pairs of grinding wheels G1*a*, G1*b*, G2*a*, G2*b*—G4*b* are disposed on the work support 10 at regular spaced intervals in the X-axis direction. The dressing rolls 20*a*–20*d* are supported for rotation about respective vertical axes and are drivingly connected to a drive motor 14 so as to be rotated thereby.

Disposed at both sides of the work support 10 are a pair of wheel slides 21 and 22, which are slidably guided on the bed 11 for forward and retraction movements in a horizontal Y-axis direction perpendicular to the X-axis direction. Each of the wheel slides 21 and 22 carries at its forward end portion near the work support 10 a plurality of grinding wheels G1*a*–G4*a* (or G1*b*–G4*b*), which are supported to be rotationally indexable about a cylindrical hollow column 30. A typical mechanism for supporting and indexing the grinding wheels G1*a*–G4*a* on the wheel slide 21 and a feed mechanism for the wheel slide 21 will be described hereafter, since they have the same construction as those of the wheel slide 22.

As shown in FIG. 2, the wheel slide 21 has fixed on its lower surface a nut 26, which is threadedly engaged with a feed screw shaft 25 extending in the Y-axis direction. The feed screw shaft 25 is connected to an output shaft of a slide feed servomotor 27, which is attached on a rear portion of the bed 11. Accordingly, the operation of the servomotor 27 causes the wheel slide 21 to move toward and away from the work support 10.

Figure 3:
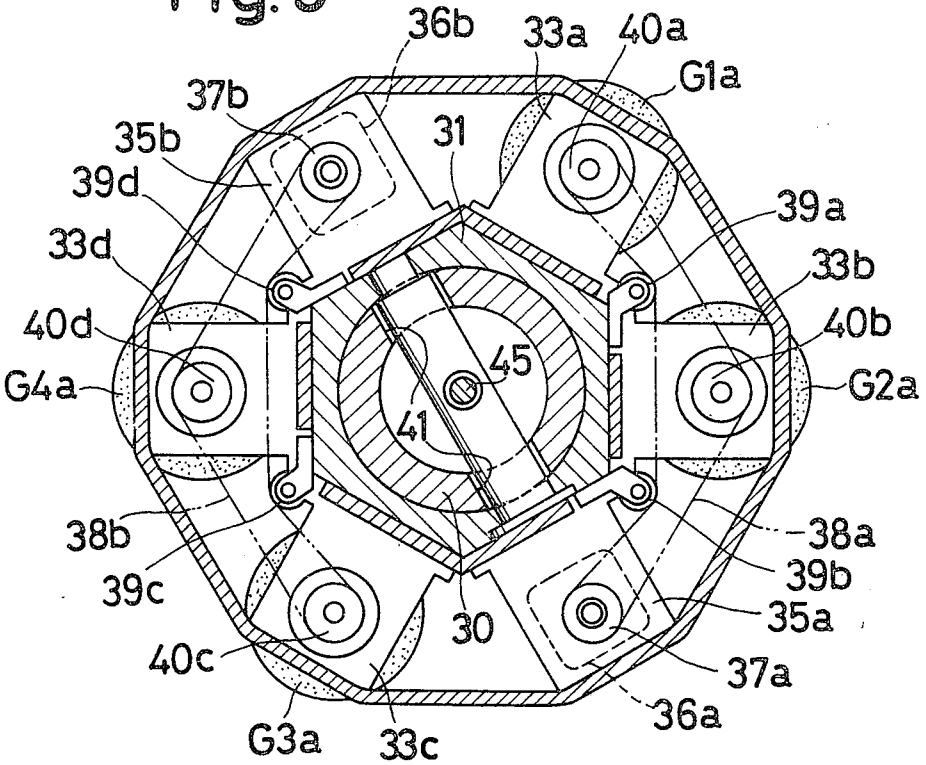
FIG. 3 is another sectional view of the machine, taken along the line III—III in FIG. 2.

The wheel slide 21 is of a C letter shape in cross-section as taken in the Y-axis direction and is formed with a pair of support ledges 21*a* and 21*b*, which respectively protrude from upper and lower parts of the wheel slide 21 at the forward side near the work support 10. The cylindrical column 30 is rotatably carried by the support ledges 21*a* and 21*b* at opposite ends thereof for angular indexing movement about a vertical axis. The cylindrical column 30 is snugly inserted into a center bore of a turret 31 so as to vertically slidably support the turret 31 on the outer surface thereof. As shown in FIG. 3, the turret 31 is a hexagon in cross-section and is formed with six vertical attaching surfaces, whose widths in the circumferential direction are approximately the same. A plurality (e.g. four) of wheel heads 33*a*–33*d* are respectively fixed on two pairs of attaching surfaces, each pair of which are located at opposite sides with respect to the axis of the turret 31. The wheel heads 33*a*–33*d* rotatably carry vertically extending wheel spindles 32, which are provided with grinding wheels G1*a*–G4*a* secured to lower ends thereof.

The remaining pair of the attaching surfaces are provided with support brackets 35*a* and 35*b* attached thereto, on which wheel drive motors 36*a* and 36*b* are fixedly mounted with their output shafts extending upwardly. Each of the wheel drive motors 36*a* and 36*b* is provided for rotating the grinding wheels respectively carried by two wheel supports 33*a* and 33*b* (or 33*c* and 33*d*) that are located in a counterclockwise direction with respect to each wheel drive motor 36*a* (or 36*b*) as viewed in FIG. 3. That is, driving power of each drive motor 36*a* (36*b*) is transmitted to two related grinding wheels G1*a* and G2*a* (G3*a* and G4*a*) through a pulley 37*a* (37*b*) keyed on an output shaft of each drive motor 36*a* (36*b*), a belt 38*a* (38*b*), and pulleys 40*a* and 40*b* (40*c* and 40*d*) respectively keyed on the wheel spindles 32 of the wheel heads 33*a* and 33*b* (33*c* and 33*d*).

Description will now be made with respect to a feed mechanism for vertically moving the turret 31 relative to the wheel slide 21 and an index mechanism for rotationally indexing the turret 31. At an axial mid portion of the cylindrical hollow column 30, a vertically elongated radial through hole 41 is formed across the axis of the column 30. A nut bar member 42 whose width is slightly narrower than that of the vertically elongated through hole 41 horizontally extends through the vertically elongated through hole 41, with opposite ends of said bar member 42 being fitted in the turret 31. The column 30 is mounted to the wheel slide 21 via roller bearings so that the hollow column 30 is rotatable substantially bodily with the turret 31 about a vertical axis, due to the rotation of bar member 42. The nut bar member 42 is threadedly engaged with a feed screw shaft 45, which is supported by the upper support ledge 21*a*. The feed screw shaft 45 is axially fixed by support ledge 31*a* but is rotatable about the axis of the hollow column 30. The screw shaft 45 is connected to a turret feed servomotor 43 fixed on the top of the upper support ledge 21*a*, so that the rotation of the servomotor 43 causes the turret 31 to vertically (i.e., in a Z-axis direction) move relative to the wheel slide 21. The rotation of the shaft 45 will cause the bar member 42 to move axially along the threaded portion of the shaft 45 when the bar member, hollow column and turret are rotationally fixed, as is described below.

Furthermore, an index wheel 46 is fixed on the upper end of the hollow column 30 in axial alignment therewith. The index wheel 46 is formed with a gear sector 46*a* at its upper circumferential surface and six index notches 47 on its lower circumferential surface at equiangular intervals. The gear sector 46*a* is meshed with a pinion 50, which is rotatable by an index drive motor 48 fixed on the top of the upper support ledge 21*a*. An upper sleeve 51, fixedly mounted on the upper support ledge 21*a* and rotatably supporting the upper end of the hollow column 30 through bearings, slidably guides a positioning rod 52 to and away from the lower circumferential surface of the index wheel 46. The positioning rod 52 is movable by a positioning cylinder 53 secured to the upper sleeve 51 so as to bring the front end of the rod 52 into selective engagement with one of the six index notches 47, thereby locking the turret 31 at any one of six indexed positions. An internal surface of the turret 31 is formed with four radially opposed engaging notch ways 55 (only one shown) at angular positions that respectively correspond to the attaching positions of the wheel heads 33*a*–33*d*. Each of the four engaging notch ways 55 extends through vertical length which corresponds to the vertical feed stroke of the turret 31. Four auxiliary positioning cylinders 56 are received in the hollow column 30 at positions which respectively correspond to the four engaging notch ways 55 in the circumferential direction of the hollow column 30. As illustrated in FIG. 2, each of these cylinders 56 includes a piston rod 56 formed at its one end with a wedge-shape engaging portion, which is extensible beyond the circumferential surface of the hollow column 30 for engagement with a corresponding one of the engaging notch ways 55.

In order to counterbalance the weight of the turret 31, a balance weight 57 is provided in the wheel slide 21. The balance weight 57 is vertically guided along a pilot bar 58, which is fixed on the wheel slide 21 at opposite ends thereof. The weight 57 is connected to the nut bar member 42 through a wire rope 60 and a bearing mechanism 61. The bearing mechanism 61 permits relative rotation between a rope hook member 62 and the nut bar member 42 to thereby prevent the wire rope 60 from being wound round the feed screw shaft 45. Numerals 63 and 64 respectively designate rollers for guiding the wire rope 60.

The operation of the apparatus as constructed above will now be described. In advance of automatic operation start, The work support 10 is positioned to a workpiece set-up station indicated by the phantom line in FIG. 1. Workpieces W to be machined are set up on the rotary tables 15 in this situation, whereafter an operation start is instructed by an operator to a machining control system, not shown.

This causes the machining control system to operate so that one of the grinding wheels G1*a*–G4*a* which is required for a first grinding operation is indexed into a grinding position. In this index operation, the index motor 48 is operated until the grinding wheel designated in accordance with numerical control data is presented to such a machining station as to face the work support 10. The turret 31 is rotated together with the index wheel 46, hollow column 30 and the nut bar member 42 by the index motor 48 and gear 50. The index motor 48 is deenergized when the indexing of the designated grinding wheel to the machining station is confirmed by a position detector, not shown. The completion of this operation is then followed by the actuation of the positioning cylinder 53 and the actuation of one of the auxiliary positioning cylinders 56 that corresponds to, and is opposed to, the wheel support now at the machining station, with the axis of hollow column 30 being therebetween, these cylinders having previously been retracted. The positioning rod 52 is brought into engagement with one of the four engaging notches 47, and the piston rod 56*a* of the actuated auxiliary positioning cylinder 56 brings its wedge-shaped engaging portion into engagement with one of the four engaging notch ways 55 so as to push the turret 31 rearwardly relative to the hollow column 30. Therefore, the hollow column 30 is precisely positioned relative to the wheel slide 21, and the turret 31 is precisely positioned relative to the hollow column 30. As a result, the turret 31 is precisely positioned relative to the wheel slide 21, with the clearance between the hollow column 30 and the turret 31 at the side of the machining station being reduced to zero, whereby supporting rigidity of the wheel head having been indexed to the machining station can be greatly enhanced.

The foregoing description is made with respect to the turret index operation on the wheel slide 21. It is to be noted however that the same turret index operation is simultaneously carried out also on the wheel slide 22, wherein one of the grinding wheels G1*b*–G4*b* designated by the numerical control data is indexed to a machining station facing the work support 10.

In the case where the workpieces W are turbine blades, each having a mounting portion whose outer surfaces are to be machined, all of the outer surface of the mounting portion cannot be ground with a pair of grinding wheels since the mounting portion is complicated in shape. Accordingly, plural pairs of grinding wheels, wherein each pair of the grinding wheels are formed at their circumferential surfaces with a profile different from that of another pair of the grinding wheels, must be indexed to the machining station in succession to grind the mounting portion. Further, each pair of the grinding wheels must be located at different vertical positions for grinding different parts of the mounting portion.

More specifically, although not illustrated in the drawings, the mounting portion at one end of the turbine blade is formed at each of a pair of opposite end surfaces with a plurality of slots extending in the moving direction of the work support 10 and having a wave-like cross section. The mounting portion is also formed with a flat part to be ground at a different height position of the same end surface. Each of another pair of opposite end surfaces of the mounting portion is formed with a plurality of contiguous stepped surfaces to be ground. In addition, a mounting portion at the other end of the turbine blade is formed at its outer surfaces with a plurality of flat surfaces to be ground. In this connection, the grinding wheels G1*a*–G4*a* have at their circumferential surfaces different profiles which correspond to the workpiece portions that they grind, respectively. The grinding wheels G1*b*–G4*b* have at their circumferential surfaces the same profiles as those of the grinding wheels G1*a*–G4*a*, respectively.

In the aforementioned manner, a pair of grinding wheels, e.g., G1*a* and G1*b* that correspond to the portions to be first ground on a pair of opposite end surfaces of the workpiece W are rotationally indexed to the machining station. If the heights of the indexed grinding wheels G1*a* and G1*b* are to be adjusted, upon completion of such index operations, the turret feed servomotors 43 are actuated in accordance with numerical control data so as to adjust the vertical positions of the turret 31 so that the grinding wheels G1*a* and G1*b* are positioned to the height designated by the numerical control data in coincidence with the height of the portions to be first ground. The auxiliary cylinders 56 are temporarily deactuated during this time so that the turret 31 can axially move with respect to the hollow column 30. The engagement of the rod 52 in the notch 47 prevents rotation of the turret and columns. The slide feed servomotors 27 are subsequently operated in accordance with the numerical control data to forward the wheel slides 21 and 22 to respective programmed infeed positions, whereafter the work feed servomotor 13 is operated to displace the work support 10 downwardly as viewed in FIG. 1. This causes the plurality of workpieces W on the work support 10 to pass between the pair of grinding wheels G1*a* and G1*b* which have been indexed to the machining station. Consequently, the pair of opposite end surfaces of the workpiece W that respectively face the wheel slides 21 and 22 are ground to predetermined shapes by creep grinding.

As the grinding operations on the pair of opposite end surfaces of the workpiece W are completed in the manner described above, another pair of grinding wheels, e.g., G2*a* and G2*b* are rotationally indexed in the same manner as mentioned previously, with the work support 10 being located at a lowered position as viewed in FIG. 1. When another pair of opposite end surfaces of the workpiece W are to be ground, the rotary tables 15 are indexed by the operation of the work index motor 18 through 90-degrees. The turret feed servomotors 43 and the slide feed servomotors 27 are then operated in accordance with the numerical control data so as to adjust the height position and the infeed position of each of the indexed grinding wheels G2*a* and G2*b*. Following this, the work support 10 is moved upwardly, as viewed in FIG. 1, whereby the different pair of opposite end surfaces of the workpiece W are ground simultaneously.

Further, it may be required to grind another portion which is on the same opposite end surfaces as that ground in a preceding grinding operation, but which cannot be ground in the preceding grinding operation because of a difference in height and shape from the precedingly ground portion. In that case, the rotational indexing to the machining station, the height position adjustment and the infeed position adjustment are performed with respect to each of another pair of the grinding wheels G1*a*–G4*b*, whereafter the work support 10 is moved to effect a grinding operation on another portion of said opposite end surfaces. Alternatively, it may be required to grind another portion which is on the same opposing end surfaces of those portions ground in a preceding grinding operation and which has the same shape as each of those portions, but which is different therefrom only in height position and surface location in the sliding direction of the wheel slides 21 and 22. In this case, each of the already indexed grinding wheels, e.g., G2*a* and G2*b* is adjusted with respect only to its height position and its infeed position, and a machining operation is thereafter performed by moving the work support 10.

The grinding of one end of the workpiece W is performed in the foregoing manner, using the plurality of the grinding wheels G1*a*–G4*a* and G1*b*–G4*b* provided on the pair of the wheel slides 21 and 22. Depending upon the asymmetry of a pair of opposite end surfaces to be ground, a certain grinding operation may involve only one of the grinding wheels G1*a*–G4*a* or G1*b*–G4*b* supported on one of the wheel slides 21 and 22. Upon completion of the grinding of one end, the workpieces W are manually turned over by the operator for the purpose of the subsequent grinding operations on the other end.

When the repetition of the aforementioned operations results in completing the grinding of a predetermined number of the workpieces W, the plurality of the grinding wheels G1*a*–G4*a* and G1*b*–G4*b* provided on the pair of the wheel slides 21 and 22 are dressed with dressing rolls 20*a*–20*d*, which are supported on the work support 10 to be rotatable about respective vertical axes. The dressing operation is performed in accordance with the numerical control data in the following manner. When the dressing rolls 20*a*–20*d* are selectively and sequentially positioned to the machining station, an associated one of the grinding wheels G1*a*–G4*b* or G1*b*–G4*b* mounted on each of the wheel slides 21 and 22 is indexed to the machining station, and each of the wheel slides 21 and 22 is advanced to bring the associated one of the grinding wheels G1*a*–G4*b* or G1*b*–G4*b* into contact engagement with one of the dressing rolls 20*a*–20*d* at the machining station. In the case where the grinding wheels G1*a*–G4*a* on the wheel slide 21 respectively have the same profiles as the grinding wheels G1*b*–G4*b*, each pair of the grinding wheels G1*a* and G1*b*, G2*a* and G2*b*, G3*a* and G3*b* or G4*a* and G4*b* are simultaneously brought into contact with an associated one of the dressing rolls 20*a*–20*d* at the opposite sides so as to be dressed simultaneously.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A grinding machine comprising in combination:

a bed;

work support means mounted on said bed for supporting a workpiece and movable in a first direction;

a first feed mechanism connected to said work support means for moving the same in said first direction;

a pair of wheel slides mounted on said bed at opposite sides of said work support means in a second direction perpendicular to said first direction and slidable toward and away from said work support means in said second direction;

a pair of second feed mechanisms respectively connected to said pair of wheel slides for independently moving said wheel slides in said second direction;

a pair of turrets each supporting a plurality of grinding wheels respectively having circumferential grinding surfaces different from one another in profile, said turrets and grinding wheels being rotatable about respective axes extending in a third direction perpendicular to said first and second directions;

turret support means provided on each of said wheel slides for supporting an associated one of said turrets so that said associated one of said turrets is rotationally indexable about and movable along a turret axis extending in said third direction;

indexing means provided on each of said wheel slides for rotationally indexing said associated one of said turrets so as to selectively present ones of said plurality of grinding wheels to a machining station which is located between said pair of wheel slides;

a third feed mechanism provided on each of said wheel slides for moving said associated one of said turrets along said turret axis;

a plurality of dressing rolls disposed on said work support means linearly in said first direction and rotatable about respective axes extending in said third direction, said dressing rolls having at circumferential surfaces thereof different profiles respectively corresponding to said circumferential grinding surfaces of said grinding wheels supported by each of said turrets; and a roll drive motor mounted on said work support means for rotating said plurality of said dressing rolls.

2. A grinding machine as set forth in claim 1, wherein said turret support means includes:

a hollow column rotatably carried on each of said wheel slides for rotation about a vertical axis extending in said third direction and passing through a center bore of an associated one of said turrets for axially slidably carrying said associated one of said turrets at an external surface thereof, said hollow column being formed with an axial through hole and an axially elongated radial through hole transverse thereto; and a screw shaft extending in said axial through hole of said hollow column and supported for rotation by an associated one of said wheel slides, said screw shaft being axially fixed with respect to said associated one of said wheel slides;

a nut member threadedly engaged with said screw shaft and connected with said associated one of said turrets within said axially elongated radial through hole for vertically moving said associated one of said turrets along said hollow column as said screw shaft is rotated, said nut member being fitted in said axially elongated radial through hole in a circumferential direction of said hollow column for permitting each of said hollow columns and said associated one of said turrets to rotate bodily; and a servomotor connected to said screw shaft for rotating said screw shaft.

3. A grinding machine as set forth in claim 2, further comprising:

clamping means provided between each of said columns and an associated one of said turrets for urging said associated one of said turrets in a direction away from said work support means so as to clamp said associated one of said turrets upon said each column after the same is indexed to one of said indexing positions.

4. A grinding machine as set forth in claim 3, wherein:

each of said wheel slides is of a C-letter shape in cross-section as taken in said second direction and is formed with a pair of upper and lower ledges respectively rotatably supporting opposite ends of one of said hollow columns mounted thereon.

5. A grinding machine as set forth in claim 4, wherein:

said indexing means is provided between each of said wheel slides and an associated one of said hollow columns mounted thereon for angularly indexing an associated one of said hollow columns bodily with said associated one of said turrets.

6. A grinding machine as set forth in claim 5, wherein said work support means comprises:

a support slide slidable on said bed in said first direction; and a plurality of work tables linearly disposed on said support slide in said first direction for respectively fixedly supporting a plurality of workpieces including said workpiece.

7. A grinding machine as set forth in claim 6, wherein said plurality of said work tables are rotatable about respective axes extending in said third direction, and wherein said work support means further comprises:

work indexing means connected to said work tables for rotationally indexing said work tables.

* * * * *